US007267057B2

(12) United States Patent
Shah et al.

(10) Patent No.: US 7,267,057 B2
(45) Date of Patent: Sep. 11, 2007

(54) ENCLOSED RAILCAR JACK ASSEMBLY

(75) Inventors: Jack K. Shah, Lombard, IL (US); T. Michael Benson, New Berlin, WI (US)

(73) Assignee: TTX Company, Chicago, IL (US)

( * ) Notice: Subject to any disclaimer, the term of this patent is extended or adjusted under 35 U.S.C. 154(b) by 134 days.

(21) Appl. No.: 11/016,327

(22) Filed: Dec. 17, 2004

(65) Prior Publication Data

US 2005/0183619 A1 Aug. 25, 2005

Related U.S. Application Data

(60) Provisional application No. 60/530,368, filed on Dec. 17, 2003.

(51) Int. Cl.
*B61K 5/00* (2006.01)
*B66F 7/10* (2006.01)

(52) U.S. Cl. ..... 104/32.1; 254/89 H

(58) Field of Classification Search ..... 104/32.1, 104/33; 105/462, 425; 254/33, 45, 89 H, 254/90

See application file for complete search history.

(56) References Cited

U.S. PATENT DOCUMENTS 1,528,857 A 3/1925 Strandberg et al.
1,745,959 A 2/1930 Steiner
3,570,812 A 3/1971 Finkbeiner
3,730,366 A 5/1973 Berends
4,068,823 A * 1/1978 Belanger ..... 254/89 H
4,319,666 A 3/1982 Hunter
4,323,141 A 4/1982 Ragan et al.
4,461,455 A 7/1984 Mills et al.
4,805,875 A * 2/1989 Jackson et al. ..... 254/2 R
4,938,305 A 7/1990 Park
5,133,531 A * 7/1992 Grashoff et al. ..... 254/89 H
5,876,018 A * 3/1999 Crisp et al. ..... 254/33
6,173,941 B1 * 1/2001 Johnston ..... 254/89 H

* cited by examiner

*Primary Examiner*—S. Joseph Morano
*Assistant Examiner*—Robert J. McCarry, Jr.
(74) *Attorney, Agent, or Firm*—Brinks Hofer Gilson & Lione

(57) ABSTRACT

The disclosed jack assembly is used to lift the frame of a railcar above a wheeled truck assembly in order to replace or perform maintenance upon the wheeled truck assembly. The jack assembly comprises a pair of hydraulically-powered lifting mechanisms located at opposing ends of a railcar-engaging member, such that the lifting mechanisms and the railcar-engaging member move as a unit to raise the frame of the railcar.

19 Claims, 14 Drawing Sheets

ENCLOSED RAILCAR JACK ASSEMBLY

RELATED APPLICATIONS

The present patent document claims the benefit of the filing date under 35 U.S.C. §119(e) of Provisional U.S. Patent Application Ser. No. 60/530,368, filed Dec. 17, 2003, which is hereby incorporated by reference herein.

TECHNICAL FIELD

The present invention relates to the field of lifting devices, and more particularly to a railcar jack assembly.

BACKGROUND OF THE INVENTION

A typical railcar has an elongated frame and a pair of wheeled truck assemblies attached to the frame. Each truck assembly is attached to the frame at each end of the railcar. Each wheeled truck assembly in turn includes flanged wheels that are adapted to roll on a pair of railroad track rails.

With the wheels on the railroad track rails, there may be clearance of only a few inches between the top of the rails and the underside of the railcar frame. Routine maintenance may require that the railcar frame be elevated somewhat in order to increase this clearance so that the underside of the frame may be serviced. One form of maintenance may require that the railcar be completely removed from one of the truck assemblies, to allow such truck assembly to be replaced or serviced. For example, to remove the assembly, the one end of the railcar may be lifted vertically about 10-30 inches, while the other end of the railcar remains supported on the other wheeled truck assembly. With the one railcar end so elevated, both old and new truck assemblies can be rolled along the rails.

One way of lifting one end of the railcar is by means of a crane. This is done by connecting the lift line of the crane to the railcar frame, such as at the railcar coupling. This requires the presence of a high capacity crane that can carry the load of the railcar, and such a crane will typically be quite large and represent a significant capital investment. Moreover, such a crane may be mounted on a special railroad service railcar or road vehicle. If the crane is limited to rolling along on track rails, it may not be conveniently moved from one site to another. If the crane is on a road vehicle, the crane may be used only at certain rail sites because of its size.

Another way the railcar can be removed from the wheeled truck assembly is by means of a pair of separate lift jacks, interposed between the underlying rail bed and each side of the railcar frame. These jacks are relatively inexpensive and quite portable. However, as the separate jacks bear against the rail bed, special shoring efforts may be needed in order to provide added stability to the jacks and to prevent the jacks from sinking into the rail bed. Moreover, with the jacks on opposite sides of the railcar, several people may be needed to operate the jacks.

One example of a railcar jack assembly is described in U.S. patent application Ser. No. 10/404,001, entitled "Center Sill Car Jack Utilizing Air Bellows" filed on Mar. 31, 2003. The jack assembly in such application incorporates a set of bellows to raise a car-engaging means that, in turn, lifts the railcar above a wheeled truck assembly.

Moreover, there are certain inherent risks with the use of either the crane or paired lift jacks because they bear the entire load of the railcar during the time the wheeled truck is removed from the railcar or while someone is under the railcar for servicing. A crosswind may cause the crane-suspended railcar to sway, or the paired jack-supported railcar may topple sideways off of the jacks. This can be both dangerous to personnel and destructive to property. Dangerously, any failure of the crane lift line or of either jack can allow the raised railcar to fall.

BRIEF SUMMARY

The present invention provides an apparatus and method for raising and lowering a railcar.

In one aspect of the invention, a jack assembly is provided. The jack assembly includes a pair of spaced-apart frame rails. The jack assembly also includes a power unit that is operatively attached to the frame rails. The power unit is configured to actuate a first lifting mechanism and a second lifting mechanism. The first lifting mechanism is spaced apart from the second lifting mechanism. The jack assembly further includes a railcar engaging mechanism that is operatively connected to the first and second lifting mechanisms.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
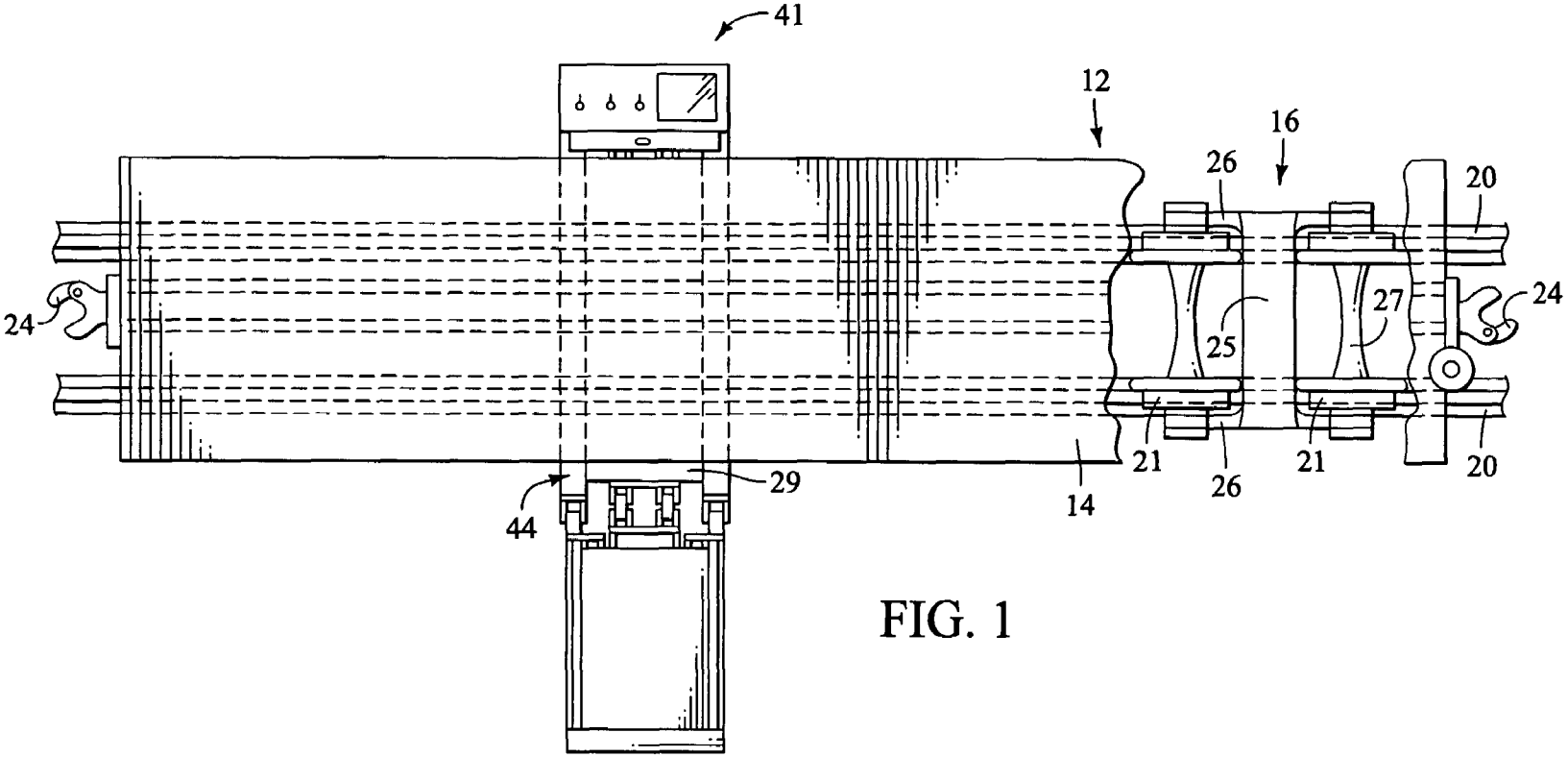
FIG. 1 is a top view of an embodiment of a center sill rail car with a jack assembly of the present invention in an operative position.

FIG. 1 is a top view of one embodiment of an enclosed railcar jack assembly 41 in a preferred operative position beneath a center sill railcar 12. A section of railcar flooring 14 has been cut away to show the location of a wheeled truck assembly 16 with respect to the railcar frame and the railroad track rails.

Figure 2:
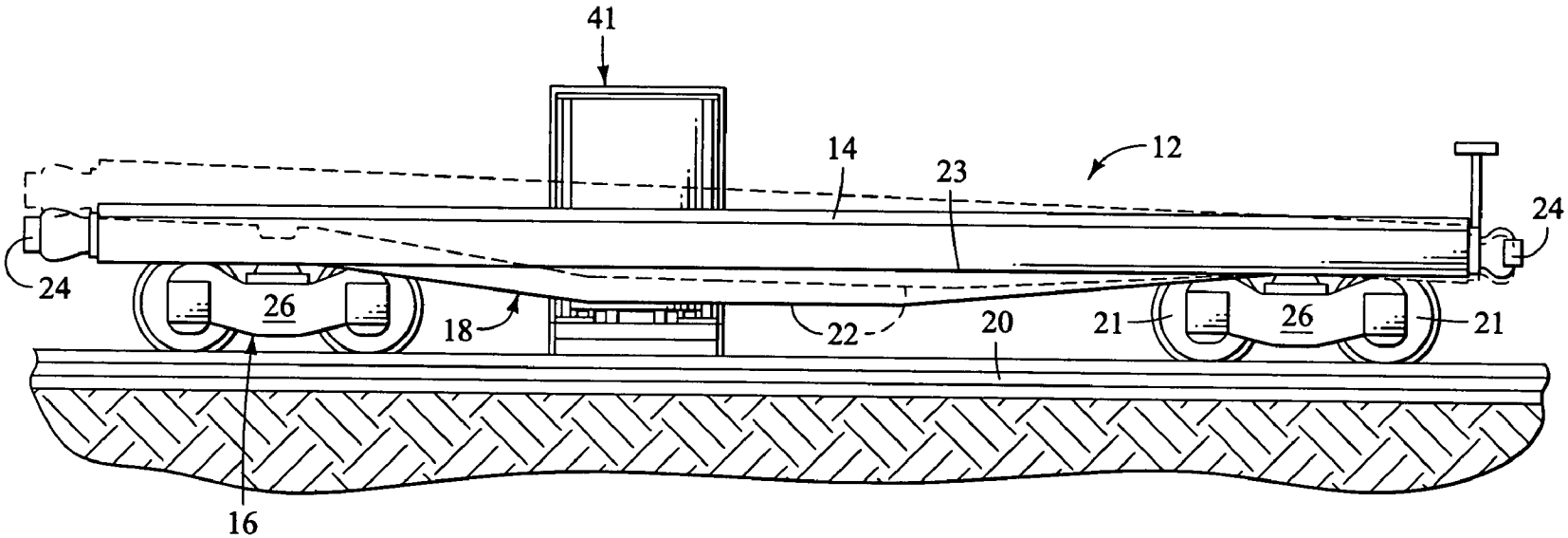
FIG. 2 is a side view of the center sill railcar of FIG. 1 with the jack assembly in an operative position.

In a first exemplary embodiment, a flat-bed railcar 12 has flanged wheels 21 adapted to roll on two laterally spaced track rails 20, as illustrated in FIGS. 1 and 2. The railcar 12 has a frame 18 including a central sill 22 and side channels 23, each elongated in the direction of the track rails 20. A wheeled truck assembly 16 is connected to the central sill 22 of the frame 18 at each end of the railcar 12. Couplings 24 are connected to the frame 18 at the opposite ends of the railcar 12.

Figure 3:
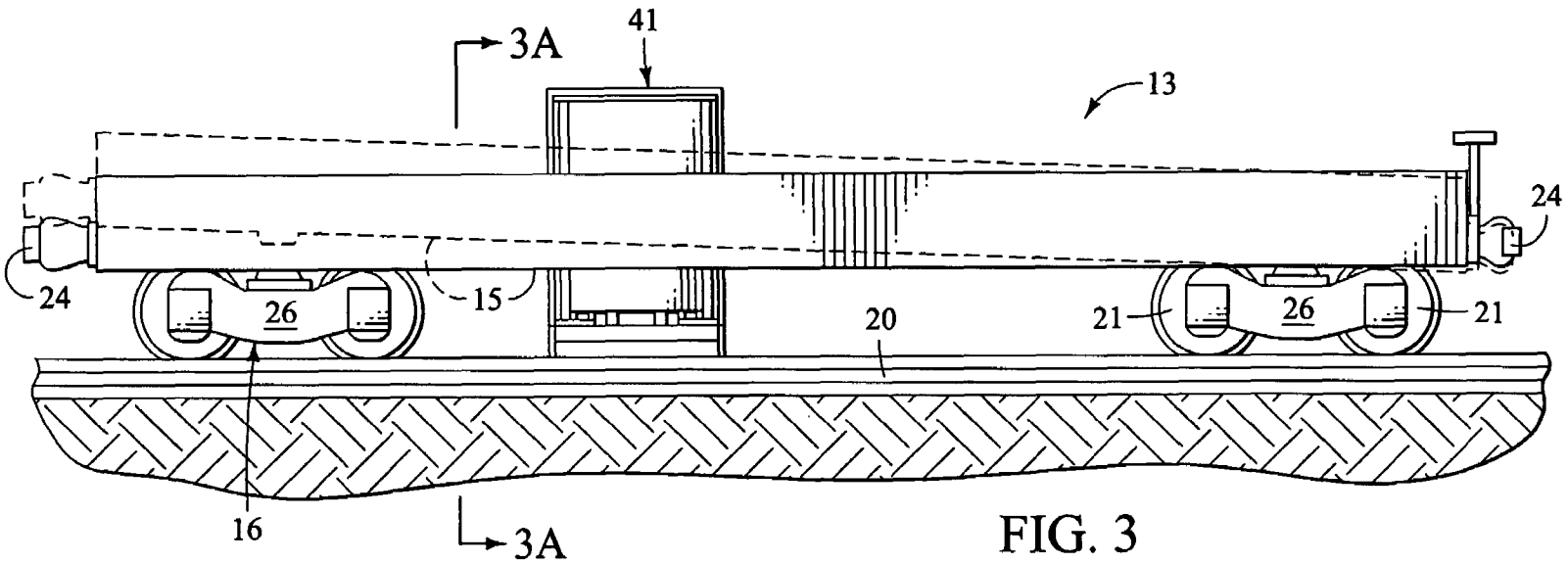
FIG. 3 is a side view of a double stack railcar with a jack assembly in an operative position.
Figure 3A:
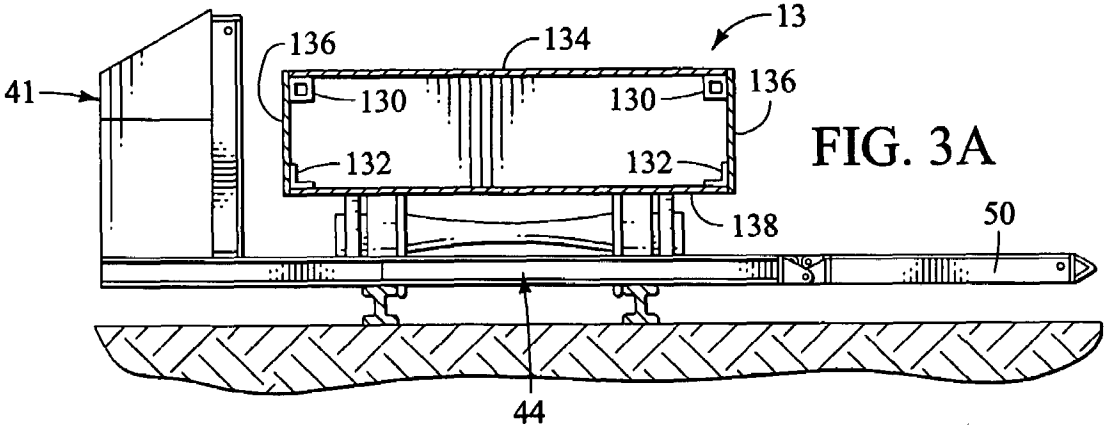
FIG. 3A is a cross-sectional view of the double stack railcar of FIG. 3 taken along the line 3A-3A.

In a second exemplary embodiment, a double stack railcar 13 includes a frame 15 formed with a pair of bottom corner angles 132 arranged such that one surface of the corner angle 132 is directed vertically and the second leg of the corner angle 132 is directed toward the opposing corner angle, as illustrated in FIGS. 3 and 3A. The corner angles 132 are elongated in the direction of the track rails 20. A cross plate 138 connects the opposing corner angles 132 in order to form the lower portion of the railcar frame 15. A side sill 136 extends vertically from the upwardly-directed leg of the corner angle 132, and a hollow square tube 130 is connected at the top of the side sill 136. The jack assembly 41 is configured to fit between the track rails 20 and the frame of most railcars.

As illustrated in FIGS. 1 and 2, each wheeled truck assembly 16 includes a cross member 25 and a pair of side frame members 26. The cross member 25 is coupled at its ends through spring and snubbing means (not shown) to the side frame members 26. One flanged wheel 21 is fixed adjacent each end of axle 27, and two such axles 27 are mounted in bearings (not shown) carried in the opposite respective side frames 26.

A typical railcar 12 may be approximately ten feet wide, across the exterior of its side sections or flooring 14. The railcar 12 rides centered relative the track rails 20, which conventionally may be separated by approximately four and one-half feet. With the wheels 21 on the track rails 20, there may be only about 10 inches of vertical clearance between the tops of the track rails 20 and the underside of the railcar frame 18 at the central sill 22.

The jack assembly 41, to be discussed further herein, may be used to lift the railcar frame 18. For example, the railcar frame 18 may be lifted completely off of a single wheeled truck assembly 16, as shown in phantom lines in FIGS. 2 and 3. The jack assembly 41 is placed between the wheeled truck assemblies 16, usually closer to one wheeled truck assembly 16 while still being able to engage the frame 18 of the railcar. The operative position of the jack assembly 41 is preferably where the railcar-engaging section 44 is disposed between the central sill 22, or the frame, of the railcar and the track rails 20. In the operative position, the railcar-engaging member 29 can engage the frame 18 and lift the frame 18 to a position spaced above the wheeled truck assembly 16 while the frame 18 remains supported on the opposite wheeled truck assembly 16. Each wheeled truck assembly 16 is self-contained, and can be easily connected to or separated from the railcar 12.

Figure 4:
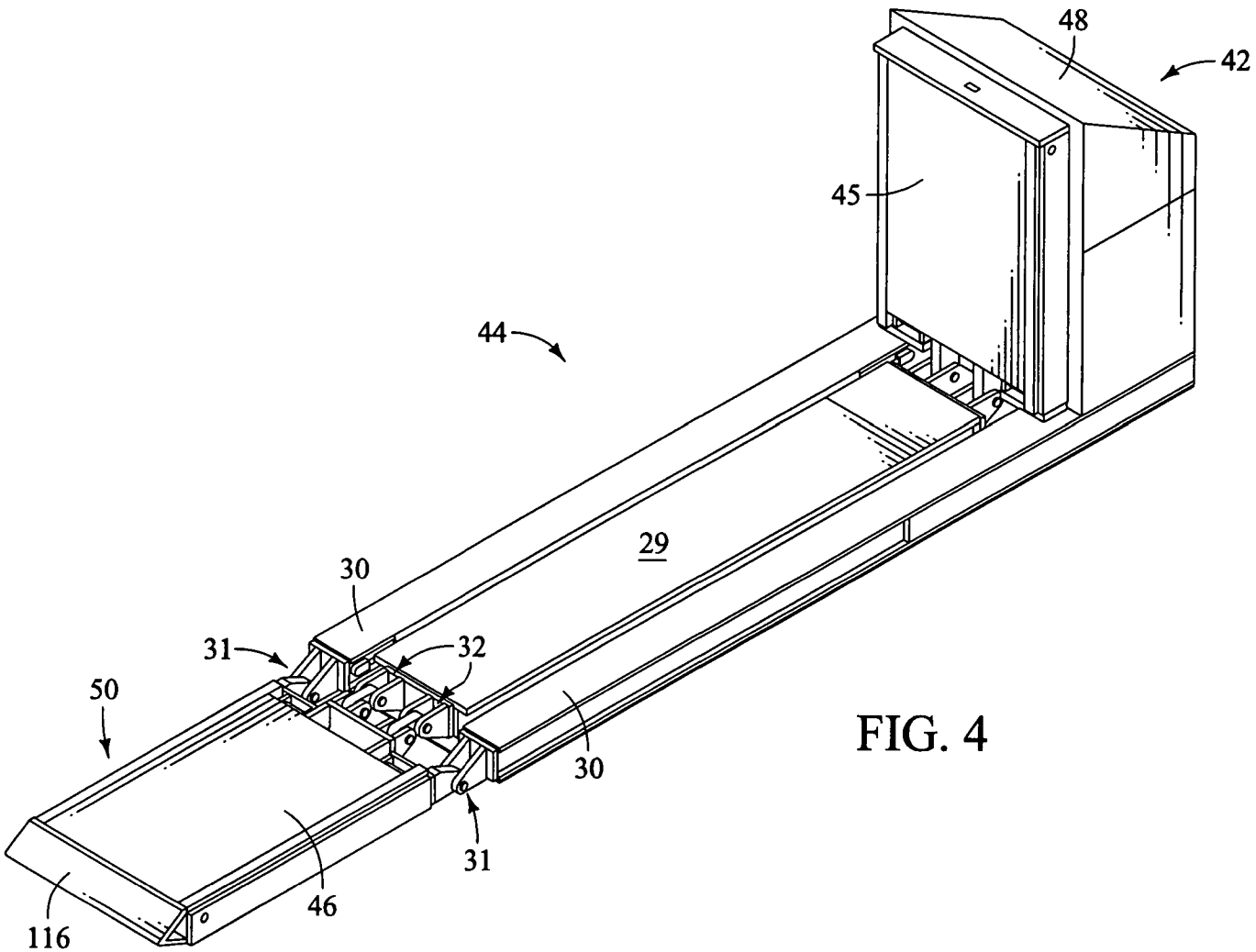
FIG. 4 is a top perspective view of an embodiment of a jack assembly of the present invention.

As illustrated in FIG. 4, the jack assembly 41 includes four distinct operational areas: a power unit 42, a railcar-engaging section 44, and a pair of enclosed lifting mechanisms 45, 46 located at opposing ends of the railcar-engaging section 44. The power unit 42 is located within a housing 48 disposed at the end of the jack assembly 41 opposite the tilt arm 50. The first lifting mechanism 45 is located adjacent to the power unit 42. The housing 48 and the first lifting mechanism 45 are preferably disposed atop the frame rails 30 of the railcar-engaging section 44. The first lifting mechanism 45 remains in the vertical orientation at all times while the tilt arm 50 is rotatable between horizontal and vertical positions. The tilt arm 50 encompasses a second lifting mechanism 46 and includes attachments, which will be described below, to connect the tilt arm 50 to the railcar-engaging section 44. The railcar-engaging section 44 is configured to rest atop the track rails 20 and engage the frame 18 of the railcar 12 when the lifting mechanisms 45, 46 of the jack assembly 41 are raised. The tilt arm 50 is configured to be in a substantially horizontal position when being placed beneath or removed from below the railcar 12.

Figure 8:
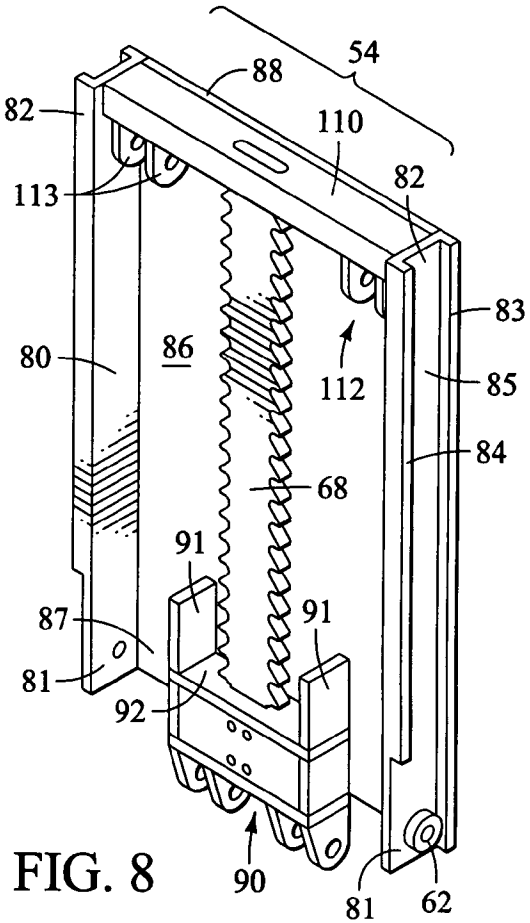
FIG. 8 is a top perspective view of a moving mast assembly.
Figure 7:
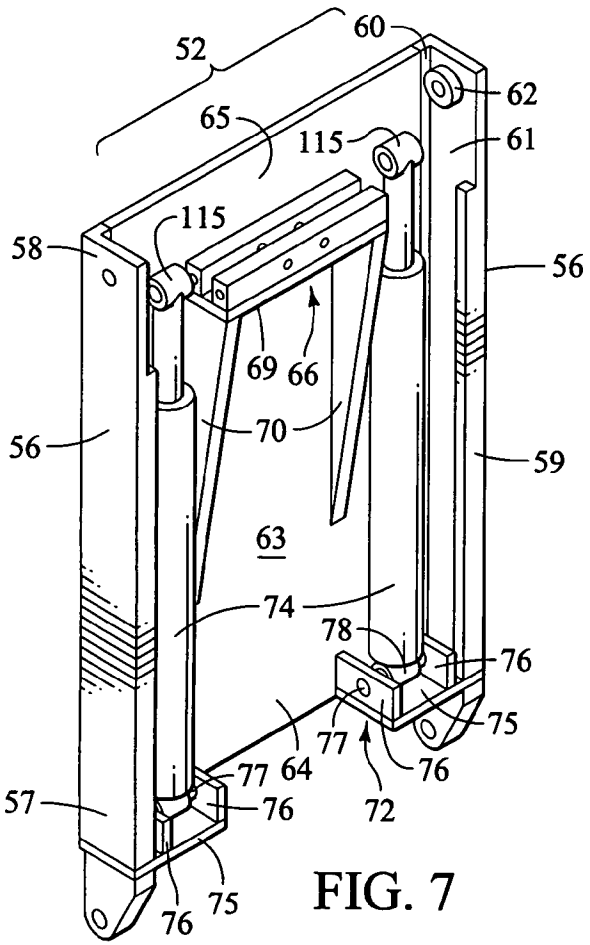
FIG. 7 is a top perspective view of a fixed mast assembly.

Each lifting mechanism 45, 46 of the jack assembly 41 includes a fixed mast 52 and a moving mast 54, as illustrated in FIGS. 7 and 8, respectively. FIG. 7 illustrates one embodiment of a fixed mast 52. The fixed mast 52 includes a pair of generally parallel, spaced-apart side members 56. The side members 56 have a first distal end 57, a second distal end 58, and a c-shaped cross section. The c-shaped cross section includes a top edge 59, a bottom edge 60, and a flange 61 that connects the top and bottom edges 59, 60, as illustrated in FIG. 9B. The side members 56 are oriented such that the c-shaped cross-sections are directed inward toward each other. The side members 56 are oriented such that the c-shaped cross section of each side member 56 is directed toward opposing side member 56 of the fixed mast 52. The side members 56 act as guides to control the movement of the moving mast 54 as well as provide the side surfaces for an enclosed lifting mechanism 45, 46. As shown in FIG. 7, a portion of the top edge 59 of each side member 56 is removed at the second distal end 58, and a roller 62 is coupled to the inward-facing surface of the flange 61 at a location within the area removed from the top edge 59. The roller 62 coupled to the flange 61 is configured to provide a rolling engagement between the fixed mast 52 and the moving mast 54.

Figure 5:
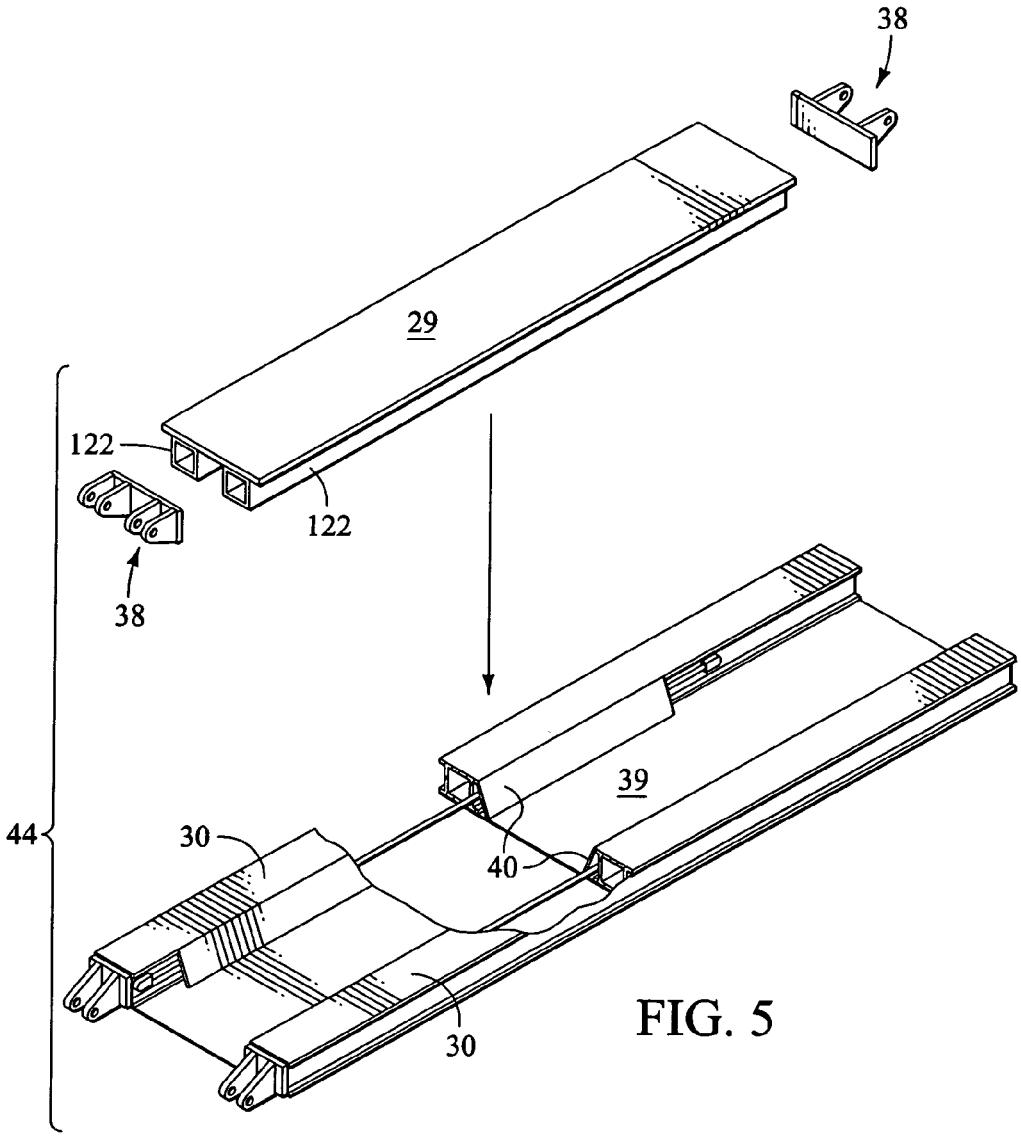
FIG. 5 is an exploded top perspective view of the car engaging section thereof.
Figure 6A:
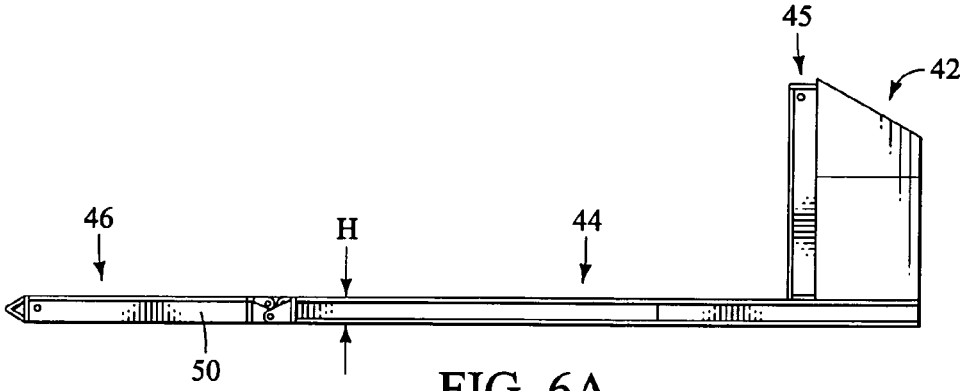
FIG. 6A is a side view of a jack assembly in an operative position.

The first lifting mechanism 45, the tilt arm 50, and the power unit 42 are connected by the railcar-engaging section 44, as illustrated in FIG. 4. In one embodiment, the railcar-engaging section 44 includes a pair of generally parallel, spaced-apart frame rails 30, a base plate 39, a railcar-engaging member 29, and conduits 40 for the electrical and hydraulic connections, as illustrated in FIG. 5. The railcar-engaging section 44 is configured to be located between the frame of a railcar and the railroad track rails 20, wherein the frame rails 30 and the base plate 39 of the jack assembly 41 rest upon the top surfaces of the track rails 20 in a substantially perpendicular relationship. The vertical height H of the railcar-engaging section 44 and the tilt arm 50, as illustrated in FIG. 6A, is about 15.2-16.5 cm (6-6½ in.). However, it should be understood by one skilled in the art that the height H can be of any length sufficient to allow the railcar jack to be disposed between track rails and the frame of a railcar. The height H of the railcar-engaging section 44 and the tilt arm 50 is such that the jack assembly 41 can be disposed between the railroad track rails and the lowermost portion of the frame of nearly all conventional railcars. In addition, the hydraulic cylinders 74 of the lifting mechanisms 45, 46 provide an operative stroke sufficient to lift the frame of nearly all conventional railcars including, but not limited to, center sill and double stack railcars. The capability of the enclosed jack assembly 41 to be operated in conjunction with nearly all railcars provides an advantage over other jack assemblies that are usually configured to be used with a particular railcar.

In one embodiment, the frame rails 30 are hollow tubes, as illustrated in FIG. 5, having a generally square cross-section in order to provide fork pockets located at the ends of the frame rails 30 adjacent to the power unit 42. The fork pockets allow for the forks of a forklift to be inserted into the hollow frame rails 30. The use of a forklift to lift and move the jack assembly 41 allows provides great mobility of the jack assembly 41 between locations. In an alternative embodiment, the frame rails are solid rods, and have a hollow tube attached to the end of the solid frame rails opposite the tilt arm, thereby creating the fork pockets. It should be understood by one skilled in the art that the frame rails can be formed of any shape or size that is sufficient to withstand the loadings of a railcar.

The bottom surface of the opposing frame rails 30 are attached to the top surface of a base plate 39, whereby a seat is created for the railcar-engaging member 29 and plate supports 122, as illustrated in FIG. 5. In one embodiment, conduits 40 for the electrical and hydraulic connections are located within the seat formed by the base plate 39 and the frame rails 30. Each conduit 40 is formed with an conduit member that connects the upper corner on the inner surface of a frame rail 30 to a line along the top surface of the base plate 39 located a distance of about 10.5 cm (4 in.) toward the longitudinal centerline of the railcar-engaging section 44. The conduit 40 is a triangular hollow passage, and allows for the electrical wiring and hydraulic tubing to be passed from the power unit 42 to the tilt arm 50 without interference from the railcar-engaging member 29 or the plate supports 122. In an alternative embodiment, one conduit is disposed within the seat of the railcar-engaging section 44 to carry only the electrical wiring and another conduit to only carry the hydraulic lines. It should be understood by one skilled in the art that any number of conduits can be used, and the conduit 40 can be of any shape sufficient to transfer the electrical wiring and hydraulic lines from the power unit to the tilt arm 50.

In one embodiment, the railcar-engaging member 29 and plate supports 122 are disposed within the seat created by the frame rails 30, conduits 40, and the base plate 39, as illustrated in the exploded view of FIG. 5. A trunnion 38 is attached to both opposing ends of the plate supports 122 and the railcar-engaging member 29 for connection with the knuckle links 36 so that the moving masts 54 of the opposing lifting mechanisms 45, 46 are operatively connected to the railcar-engaging member 29. The plate supports 122 are elongated hollow tubes having a generally square cross-section. It will be understood by one skilled in the art that the plate supports 22 can be of any shape or size sufficient to provide structural support to the railcar-engaging member 29 and provide an attachment for the trunnions 38 The plate supports 122 are welded together to provide a structure that can withstand the bending loads applied from the railcar 12. The railcar-engaging member 29 is in turn welded to the top surface of the plate supports 122. The width of the railcar-engaging member 29 is less than the seat created by the frame rails 30 and the base plate 39 such that at least one conduit can be disposed between the railcar-engaging member 29 and plate supports 122 and the frame rails 30.

In the illustrated embodiment of FIG. 4, the power unit 42 is rotatably connected to the fixed mast 52 of the first lifting mechanism 45. In an alternative embodiment, the housing of the power unit is welded to the top surface of the opposing frame rails at the distal end opposite the tilt arm, adjacent to, but not attached to, the fixed mast 52 of the first lifting mechanism 45. The power unit 42 is encased by the housing 48 in order to prevent damage to the components during transportation from one location to another. The power unit 42 is configured to control the entire operation of the jack assembly 41. The housing 48 of the power unit 42 is rotatable between an open and a closed position. When in a closed position, the user cannot activate the power unit 42, thereby preventing activation of the jack assembly 41 when the housing is closed. The power unit 42 can include components such as a motor, a hydraulic pump, hydraulic system valves, electrical system, and a control pendant. The motor provides power to the hydraulic pump in order to operate the hydraulic cylinders used to raise and lower the lifting mechanisms and railcar-engaging member. A control pendant is attached to a cord that is in turn connected to the electrical system in order to allow the user to control the motion of the jack assembly 41. In one embodiment, the control pendant includes depressable "up" and "down" buttons, whereby the various movements of the jack assembly 41 are controlled by the buttons. In an alternative embodiment, a control panel is attached to the housing of the power unit. The control panel includes at least one lever that controls the various motions of the tilt arm and the lifting mechanisms.

As illustrated in FIG. 7, a bottom plate 63 is connected to the inner surfaces of the opposing bottom edges 60 of the side members 56 of the fixed mast 52. The bottom plate 63 is preferably welded to the side members 56, but it should be understood by one skilled in the art that any other means of attaching the bottom plate 63 to the side members 56 sufficient to withstand the transportation and operation of the jack assembly 41 can be used. The bottom edge 64 of the bottom plate 63 corresponds to the first distal end 57 of the side members 56, and the top edge 65 of the bottom plate 63 corresponds to the second distal end 58 of the side members 56. The bottom plate 63 provides a third outer surface for an enclosed lifting mechanism 45, 46.

Figure 9A:
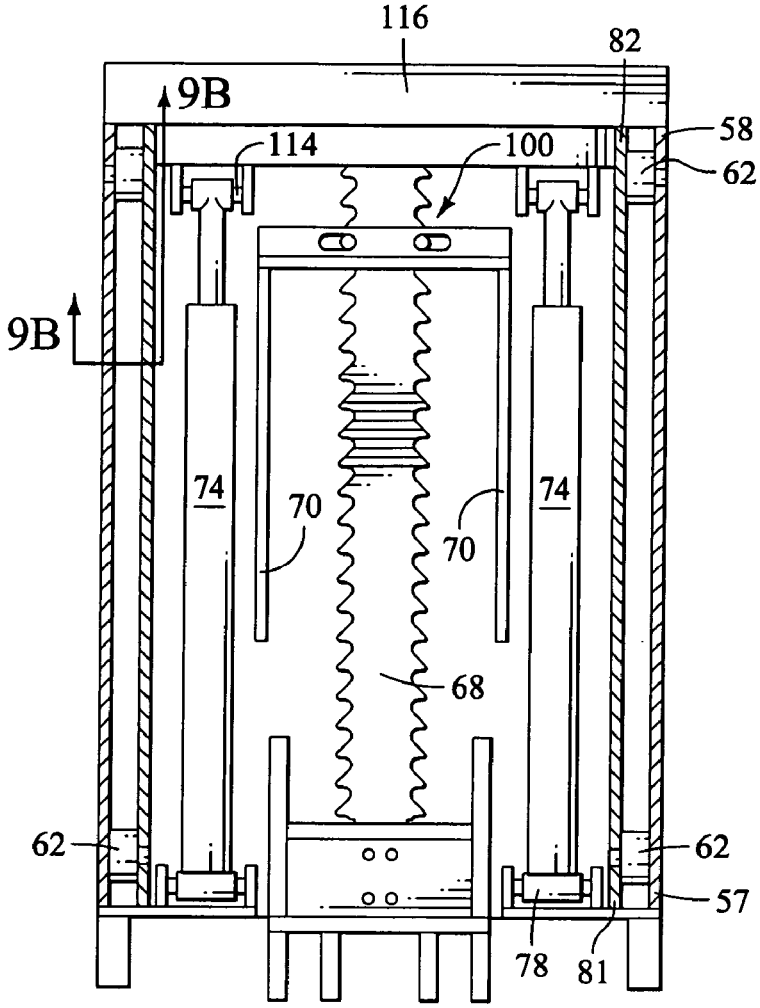
FIG. 9A is a front view of a lifting mechanism in which the top plate has been removed.
Figure 9B:
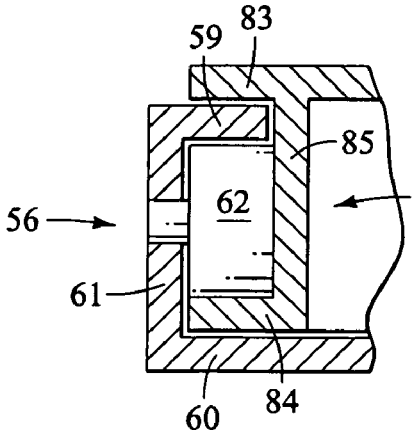
FIG. 9B is a cross-sectional view of a fixed mast side member and a moving mast side rail taken along line 9B-9B of FIG. 9A.
Figure 10:
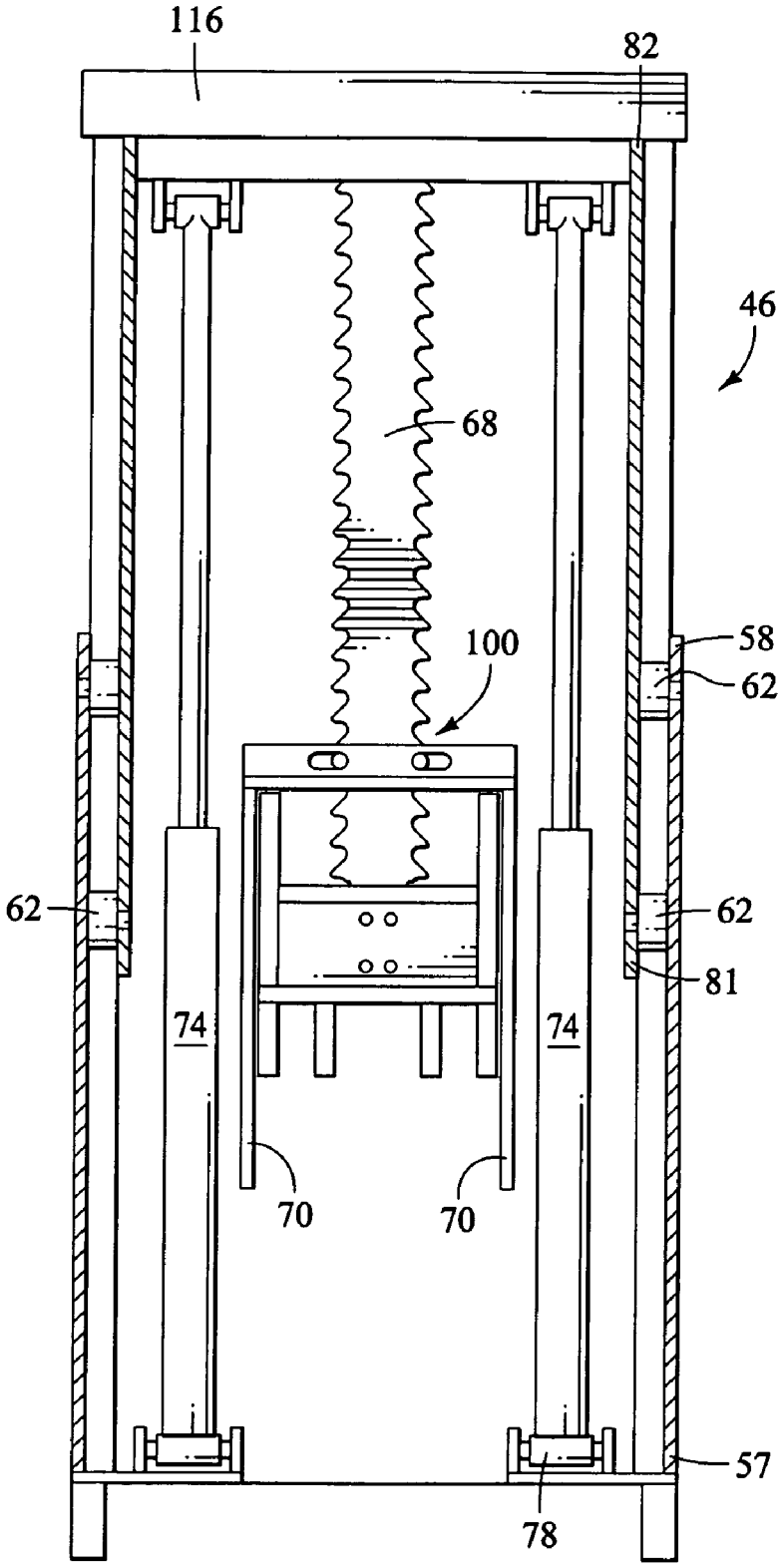
FIG. 10 is a front view of a lifting mechanism in a raised position in which the top plate has been removed.

The fixed mast 52 also includes a safety bar guide 66 attached to the bottom plate 63, and the safety bar guide 66 is configured to guide the ratchet safety bar 68 as the moving mast 54 is raised and lowered with respect to the fixed mast 52, as shown in FIGS. 9A and 10. FIG. 7 illustrates the safety bar guide 66 preferably welded to the bottom plate 63, but it should be understood by one skilled in the art that any other means of attaching the safety bar guide 66 to the fixed mast 52 sufficient to withstand the transportation and operation of the jack assembly 41 can be used. The safety bar guide 66 is an inverted u-shaped mechanism that includes a top member 69 that is oriented generally perpendicular to the side members 56 of the fixed mast 52 and two angled members 70 extending from the top member 69 in a generally parallel relationship to the side members 56. The angled members 70 extend from the top member 69 in a perpendicular manner such that the height of the angled members 70 decreases as the angled members 70 extend away from the top member 69. The top member 69 of the safety bar guide 66 is located centrally between the side members 56 of the fixed mast 52 near the top edge 65 of the bottom plate 63, and the angled members 70 extend therefrom toward the bottom edge 64 of the bottom plate 63. The top member 69 includes a slot (not shown) that is elongated in the longitudinal direction of the top member 69. The slot allows the safety bar 68 to pass through the safety bar guide 66, as shown in FIG. 9A.

A pair of lower cylinder supports 72 are attached to the bottom plate 63 of the fixed mast 52 to provide foundational support for the hydraulic lift cylinders 74, as shown in FIG. 7. Each lower cylinder support 72 includes a lower base member 75, a pair of spaced-apart lower bearing members 76, and a lower support pivot 77. The lower base member 75 is positioned at the first distal end 57 of each side member 56 of the fixed mast 52 and is oriented substantially perpendicular to the side members 56. Each lower base member 75 is preferably welded to the bottom edge 64 of the bottom plate 63 and to the end surface of an adjacent side member 56. One surface of each lower bearing member 76 is welded to the lower base member 75 and another surface is welded to the bottom plate 63 at a substantially perpendicular orientation. The lower bearing members 76 extend from the lower base member 75 toward the top edge 65 of the bottom plate 63 in a manner generally parallel with the side members 56. Each of the lower bearing members 76 includes a hole through which a lower support pivot 77 is passed in a generally normal orientation. The base mounting 78 of a hydraulic cylinder 74 is disposed between a pair of lower bearing members 76, wherein the lower support pivot 77 passes through the hole of one lower bearing member 76, through the holes of the base mounting 78 of the hydraulic cylinder 74, and then through the hole of the second lower bearing member 76. The hydraulic cylinders 74 are thereby grounded to the fixed mast 52 through the lower cylinder supports 72, and are attached to the moving mast 54 through a similar pair of upper cylinder supports 112.

In addition to the fixed mast 52, each lifting mechanism 45, 46 of the jack assembly 41 includes a moving mast 54. As illustrated in FIG. 8, the moving mast 54 includes a pair of generally parallel, spaced-apart side rails 80. The side rails 80 have a first distal end 81, a second distal end 82, and a c-shaped cross section. The c-shaped cross section includes a top edge 83, a bottom edge 84, and a flange 85 that connects the top and bottom edges 83, 84, as illustrated in FIG. 9B. The side rails 80 are oriented such that the c-shaped cross-sections are directed outwardly away from each other. When the lifting mechanisms 45, 46 are fully constructed, the first distal ends 81 of the moving mast side rails 80 are immediately adjacent to the first distal ends 57 of the fixed mast side members 56, and the second distal ends of 82 the moving mast side rails 80 are immediately adjacent to the second distal ends 58 of the fixed mast side members 56.

A portion of the bottom edge 84 of each side rail 80 is removed at the first distal end 81, and a roller 62 is attached to the outward-facing surface of the flange 85 at a location within the area removed from the bottom edge 84, as shown in FIG. 8. The rollers 62 attached to the flanges 85 of the moving mast side rails 80 are configured to be disposed between the top and bottom edges 59, 60 of the fixed mast side members 56, and the rollers 62 attached to the flanges 61 of the fixed mast side members 56 are likewise configured to be disposed between the top and bottom edges 83, 84 of the moving mast side rails 80, as illustrated in FIG. 9B. The diameter of the rollers 62 is slightly smaller than distance between the top 59, 83 and bottom edges 60, 84 of the corresponding side rails 80 or side members 56. It should be understood by one skilled in the art that the diameter of the rollers 62 must be sufficient to achieve a sliding relationship between the moving and fixed masts 54, 52 without allowing direct frictional contact between the fixed mast side members 56 and the moving mast side rails 80.

As illustrated in FIG. 8, a top plate 86 is attached to the opposing side rails 80 of the moving mast 54 by connecting the inner surface of the top edge 83 of the side rails 80. The top plate 86 is preferably welded to the side rails 80, but it should be understood by one skilled in the art that any other means of attaching the top plate 86 to the side rails 80 sufficient to withstand the transportation and operation of the jack assembly 41 can be used. The bottom edge 87 of the top plate 86 is associated with the first distal end 81 of the side rails 80, and the top edge 88 of the top plate 86 is associated with the second distal end 82 of the side rails 80. The top plate 86 provides a fourth outer surface for an enclosed lifting mechanism 45, 46.

As shown in FIG. 8, a safety bar support 90 is attached to the top plate 86 of the moving mast 54, and is configured to stabilize the lower portion of the ratcheted safety bar 68. The safety bar support 90 is preferably welded to the top plate 86, but it should be understood by one skilled in the art that any means of connecting the safety bar support 90 to the top plate 86 sufficient to withstand the transportation and operation of the jack assembly 41 can be used. The safety bar support 90 is centrally disposed between the opposing side rails 80 of the moving mast 54. The safety bar support 90 includes a pair of spaced-apart, elongated braces 91 that are elongated in a generally parallel orientation with respect to the side rails 80. The braces 91 are spaced apart by a distance greater than the width of the ratcheted safety bar 68. An elongated edge of each brace 91 is attached to the inward-facing surface of the top plate 86. Another edge of each brace 91 is generally aligned in a coplanar manner with the bottom edge 87 of the top plate 86. The braces 91 are operatively coupled to each other by way of a cross beam 92. The cross beam 92 and braces 91 form a hollow box-like structure with the top plate 86. The lower portion of the ratcheted safety bar 68 is attached to the safety bar support 90 preferably with a four-bolt pattern. It should be understood by one skilled in the art that the safety bar 68 can be attached to the safety bar support 90 by any other means sufficient to withstand the operation and transportation of the jack assembly 41.

The ratcheted safety bar 68 is attached to the moving mast 54 at both the top and bottom distal ends of the safety bar 68, wherein the middle portion of the safety bar 68 is disposed within a slot in the top member 69 of the safety bar guide 66 attached to the fixed mast 52. The size of the slot is sufficient to allow the entire width of the ratcheted safety bar 68 to easily pass through during the raising and lowering of the lifting mechanisms 45, 46. One end of the ratcheted safety bar 68 is attached to the safety bar support 90, and the opposing end is connected to the loading member 110 of the moving mast 54. The length of the ratcheted safety bar 68 is oriented in a substantially parallel relation with the longitudinal axes of the moving mast side rails 80.

Figure 11A:
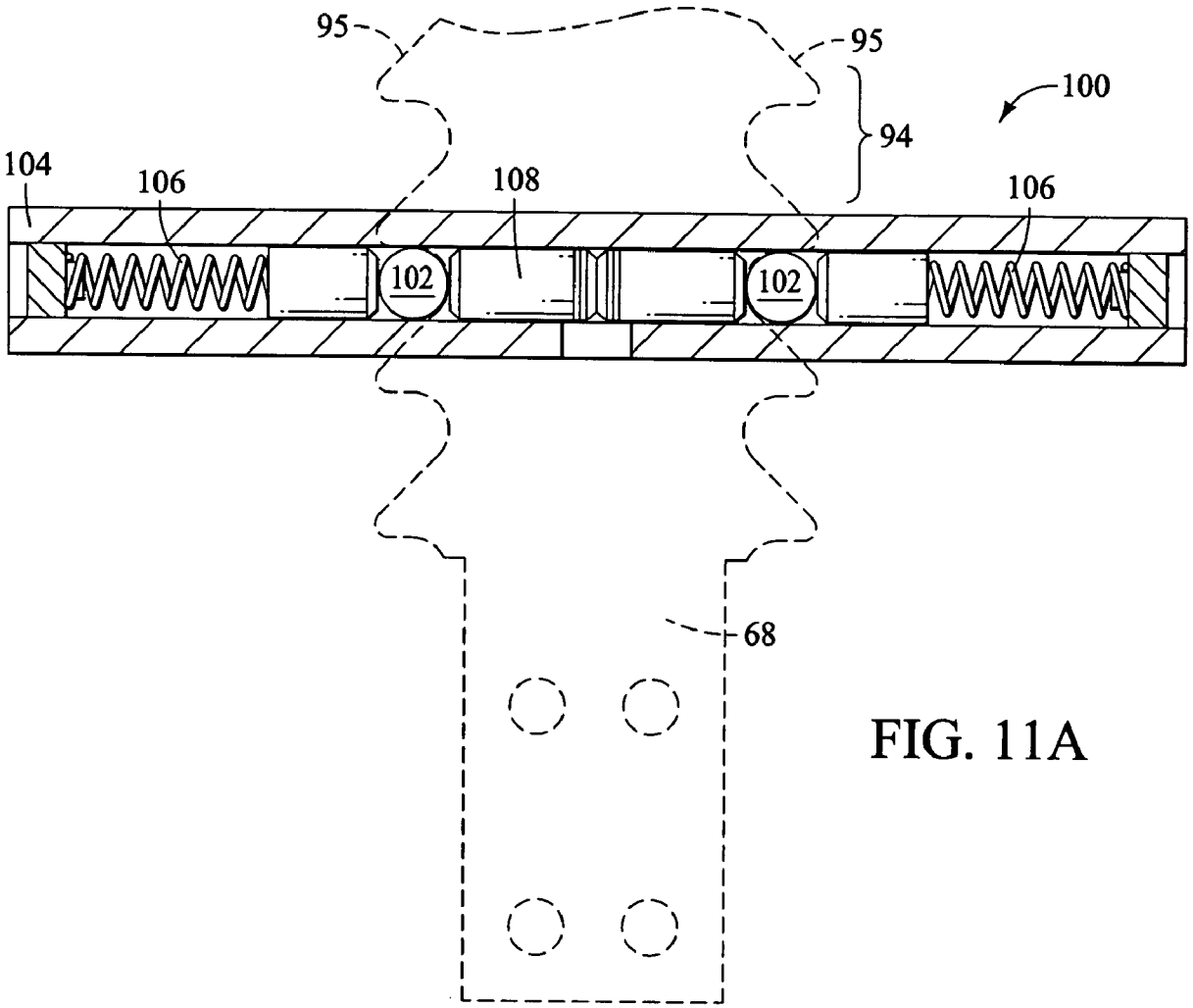
FIG. 11A is a cross-sectional view of a safety bar locking device in a locked position.
Figure 11B:
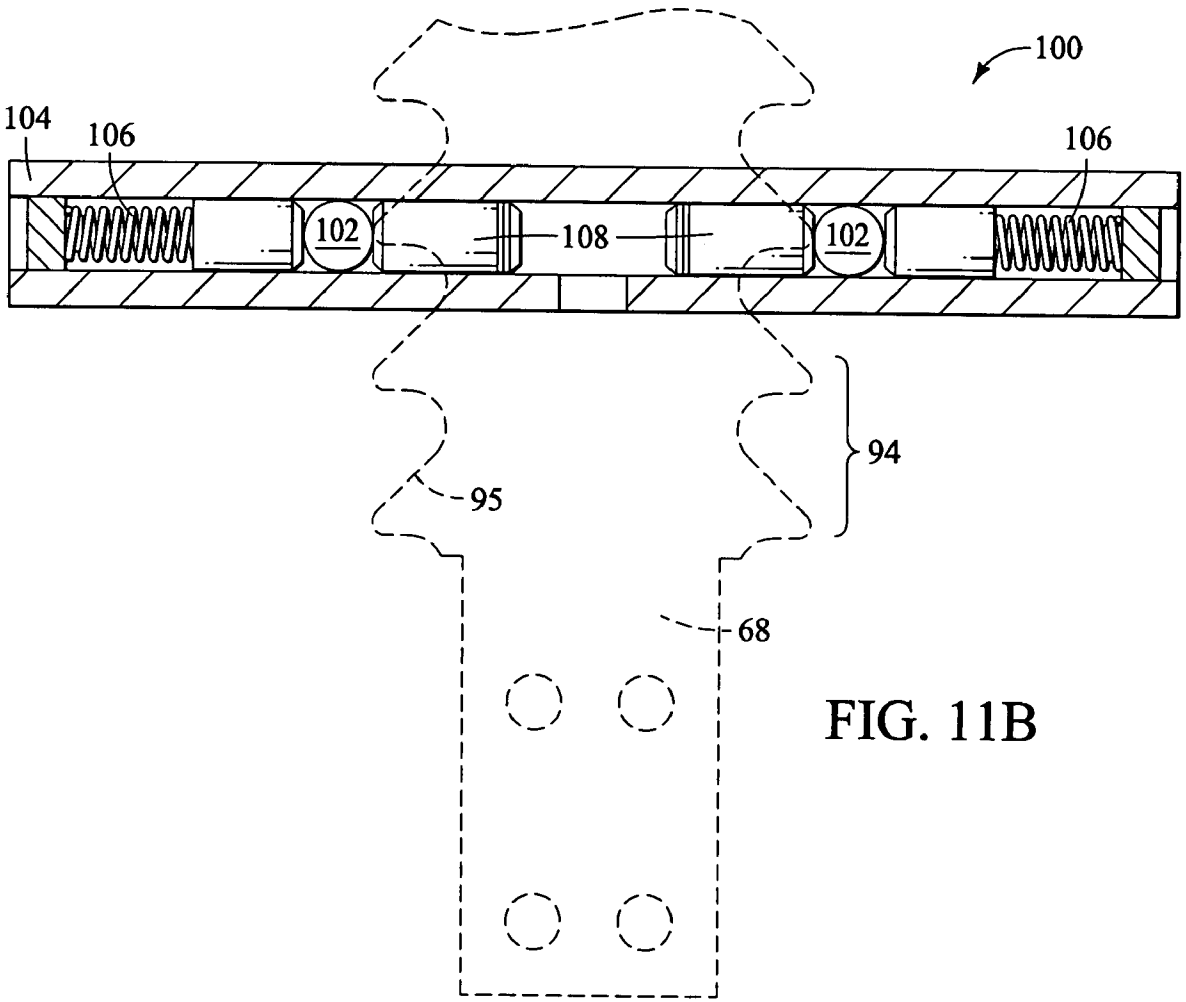
FIG. 11B is a cross-sectional view of a safety bar locking device in an unlocked position.

The edges of the ratcheted safety bar 68 form a rack 94 such that the rack 94 corresponds with the safety pins 102 of the safety bar locking mechanism 100, as illustrated in FIGS. 11A-11B, thereby forming a rack-and-pinion relationship as explained later. The ratcheted safety bar 68 is configured to be connected to the moving mast 54 so as to prevent an unexpected or sudden drop of the railcar 12 as the railcar 12 is being lifted or lowered by the jack assembly 41. For example, when the lifting mechanisms 45, 46 are acting in conjunction with the railcar-engaging member 29 to raise a railcar 12 and the power unit 42 fails, or if there is otherwise loss of hydraulic pressure, the rack-and-pinion safety bar locking mechanism 100 prevents the railcar 12 from crashing down.

The safety bar 68 acts in conjunction with the safety bar locking mechanism 100 attached to a central portion of the top member 69 of the safety bar guide 66 on the fixed mast 52 as the lifting mechanisms 45, 46 are raised and lowered, as illustrated in FIGS. 9A-11B. In one embodiment, as illustrated in FIGS. 7, 11A and 11B, the safety bar locking mechanism 100 includes an opposing, generally parallel pair of locking beams 104, a pair of safety pins 102, two pairs of die springs 106 and two pistons 108. The pair of locking beams 104 are preferably hollow tubes having a generally square cross section. However, it should be understood by one skilled in the art that the tubes can be any shape sufficient to contain the members of the safety bar locking mechanism 100. The locking beams 104 have enclosed end portions and are preferably welded to the top member 69 of the safety bar guide 66 on opposing sides of the slot. The locking beams 104 are aligned in generally the same longitudinal manner as the top member 69, and are spaced apart by at least the thickness of the safety bar 68. The pair of die springs 106 are located at the opposing closed end of a locking beam 104, and are oriented in a manner such that the biasing force of the die springs 106 is directed toward the rack 94 of the safety bar 68. A safety pin 102 is located inboard of each of the die springs 106, and each safety pin 102 passes through both opposing locking beams 104 in a normal direction. FIG. 11A illustrates the safety bar locking mechanism 100 in a locked condition such that the safety pins 102 are engaged with the rack 94 of the safety bar 68, thereby preventing downward movement of the safety bar 68 and moving mast 54 during engagement.

A dual-direction hydraulic piston 108 is disposed within the center portion of each locking beam 104 and is configured to be actuated in the longitudinal directions opposite the forces exerted by the die springs 106, as illustrated in FIGS. 11A and 11B. The die springs 106 act to bias the safety pins 102 toward the center of the safety bar locking mechanism 100 in order for the safety pins 102 to create a locking engagement with the rack 94 of the safety bar 68. However, the pistons 108 also act to disengage the safety pins 102 from the rack 94 on the safety bar 68. FIG. 11B illustrates the safety bar locking mechanism 100 in an unlocked condition such that the piston 108 is actuated to force the safety pins 102 to disengage the rack 94 of the safety bar 68 and the safety bar 68 can be lowered. The safety bar locking mechanism 100 allows all upward movement of the safety bar 68 through the safety bar guide 66, but prevents downward movement unless the hydraulic pistons 108 have been actuated.

In operation, the pistons 108 are in an actuated position as the tilt arm 50 is rotated from the horizontal to the vertical position, as shown in FIG. 11B, because the moving mast 54 is being lowered with respect to the fixed mast 52 as the tilt arm 50 is being raised to the vertical position. Once the tilt arm 50 is in the vertical position, the power supply to the pistons 108 is interrupted, and the die springs 106 bias the safety pins 102 into engagement with the rack 94 on the safety bar 68. However, the rack 94 is configured with angled surfaces 95 such that as the moving mast 54 and safety bar 68 are raised, the angled surfaces 95 of the rack 94 slidingly force the safety pins 102 outward toward the ends of the locking beams 104 until the safety pins 102 are again forced by the die springs 106 into engagement with the next inlet of the rack 94. Once the desired height of the lifting mechanisms 45, 46 is achieved, the die springs 106 continue to bias the safety pins 102 into engagement with the rack 94 on the safety bar 68 thereby maintaining the height of the lifting mechanisms 45, 46 and the railcar-engaging member 29. The safety pins 102 rest, and are retained, within the hook-shaped openings in the rack 94. To lower the lifting mechanisms 45, 46, the pistons 108 must first be actuated by the power unit 42, thereby disengaging the safety pins 102 from the inlets of the rack 94 and allowing the safety bar 68 to be lowered without interference from the safety pins 102.

The top portion of the ratcheted safety bar 68 is attached to a loading member 110 that is located at the top edge 88 of the top plate 86, as illustrated in FIG. 8. The loading member 110 is attached to the second distal end 82 of both opposing side rails 80 of the moving mast 54 such that the loading member 110 forms the fifth outer surface of an enclosed lifting mechanism 45, 46 of the jack assembly 41. The moving mast 54 of the tilt arm 50 further includes a triangular end piece 116 attached to the outward-facing surface of the loading member 110 to prevent damage to the jack assembly 41 while the jack assembly 41 is being placed in an operative position.

In addition, a pair of upper cylinder supports 112 are also attached to the inward-facing surface of the loading member 110, as illustrated in FIGS. 8 and. 9A. Each upper cylinder support 112 includes a pair of spaced-apart upper bearing members 113 and an upper support pivot 114. The pair of spaced-apart upper bearing members 113 are attached to the loading member 110 and the top plate 86 in a manner similar to the connection of the lower cylinder supports 72. Each of the upper bearing members 113 includes a hole through which an upper support pivot 114 is passed in a generally normal orientation. The rod mounting portion 115 of each hydraulic cylinder 74 is disposed between a pair of upper bearing members 113, wherein the upper support pivot 114 passes through the hole in one upper bearing member 113, through the hole in the rod mounting portion 115 of the hydraulic cylinder 74, and then through the hole in the second upper bearing member 113.

The fixed and moving masts 52, 54 of each lifting mechanism 45, 46 are operatively connected by a pair of hydraulic cylinders 74. An example of a suitable hydraulic cylinder includes the model PMC-5636 manufactured by Prince Hydraulics Corp of North Sioux City, S.Dak. The model PMC-5636 hydraulic cylinders have a 4-inch bore, a 2-inch diameter rod, a 36-inch stroke, and a 46-inch retracted height. The base mounting portion 78 of each hydraulic cylinder 74 is attached to a lower cylinder support 72 connected to the fixed mast 52 and the rod mounting portion 115 of each hydraulic cylinder 74 is attached to an upper cylinder support 112 connected to the moving mast 54, as illustrated in FIGS. 9A and 10. Additionally, upon the assembly of each lifting mechanism 45, 46, the rollers 62 attached to the moving mast 54 are disposed within the c-shaped cross section of the side members 56 of the fixed mast 52 and the rollers 62 of the fixed mast 52 are disposed within the c-shaped cross section of the side rails 80 of the moving mast 54. In operation, as the moving mast 54 is raised or lowered with respect to the fixed mast 52, the rollers 62 provide a smooth sliding connection between the fixed and moving masts 52, 54.

Figure 6B:
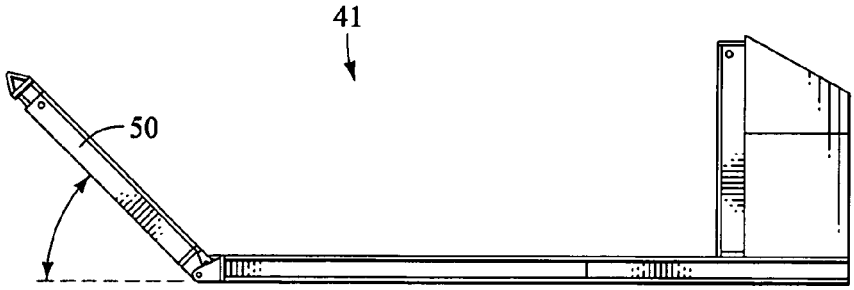
FIG. 6B is a side view of a jack assembly in which the tilt arm is between a raised and lowered position.
Figure 6C:
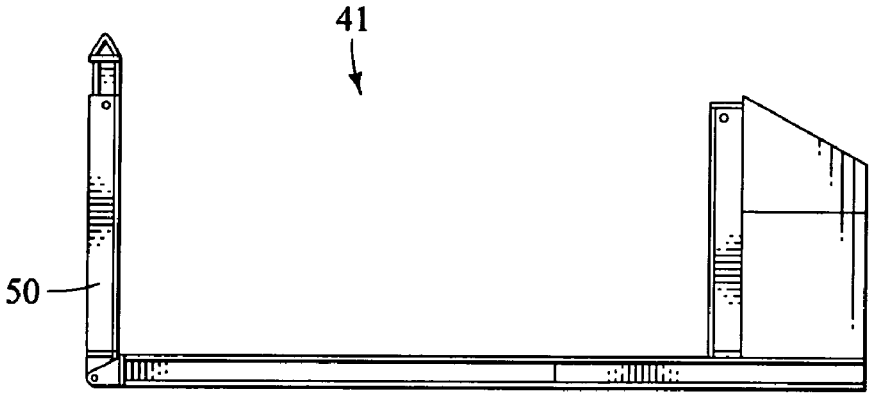
FIG. 6C is a side view of a jack assembly in which the tilt arm is in a generally vertical, or raised position.
Figure 6D:
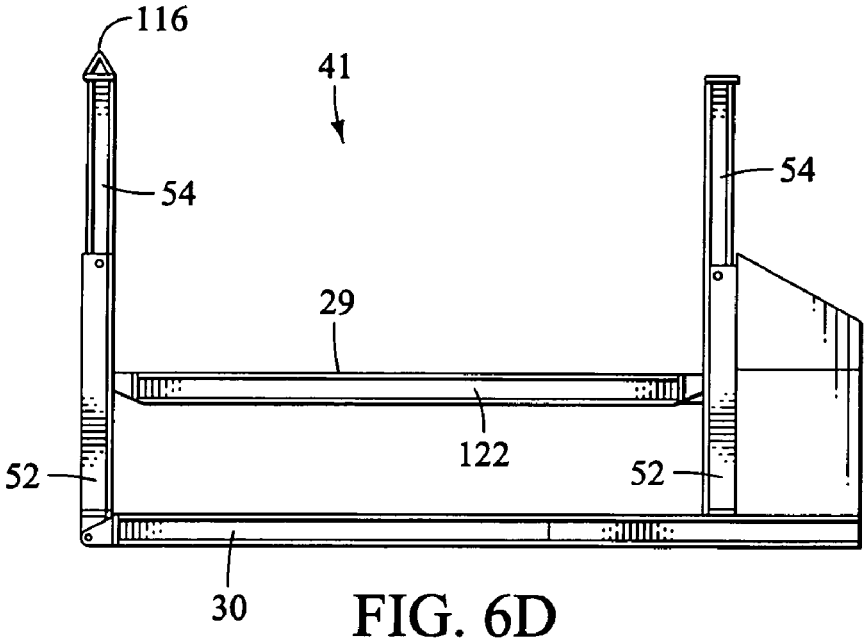
FIG. 6D is a side view of a jack assembly in which the lifting mechanisms and the car-engaging member have been raised.

The second lifting mechanism 46 is configured as a tilt arm 50. The tilt arm 50 is adapted to rotate between a first, generally horizontal, and a second, generally vertical position when the jack assembly 41 is in an operative position beneath a railcar 12, as illustrated in FIGS. 6A-6C. The tilt arm 50 is the second lifting mechanism 46, and is fully enclosed in order to prevent damage to the lifting mechanism 46 either during transportation from one location to another or during operation of the jack assembly 41. As the tilt arm 50 is rotated between the horizontal and vertical positions, both the fixed and moving masts 52, 54 rotate together as a unit. However, when the tilt arm 50 is in the vertical position, the moving mast 54 can be raised and lowered in the vertical direction with respect to the stationary fixed mast 52, as illustrated in FIG. 6D.

The tilt arm 50 is rotationally connected to the distal end of the frame rails 30 of the railcar-engaging section 44 opposite the first lifting mechanism 45 and power unit 42, as shown in FIGS. 4 and 12A-12C. In the illustrated embodiment, the tilt arm 50 is connected to the railcar-engaging section 44 at two pairs of rotational connections 31, 32. The outer rotational connections 31 are pivotal about a first axis 33. The inner rotational connections 32 utilize a trunnion 37 attached to the moving mast 54 and a corresponding trunnion 38 attached to the railcar-engaging section 44 whereby the trunnions 37, 38 are operatively connected by a knuckle link 36. A second axis 34 is formed at the coupling between the knuckle links 36 and the moving mast trunnions 37, and a third axis 35 is formed at the couplings between the knuckle links 36 and the trunnions 38 of the railcar-engaging section 44.

Figure 12A:
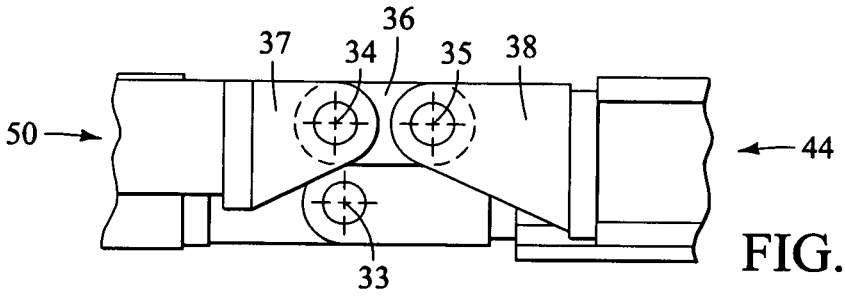
FIG. 12A is a side view of a connection between the tilt arm and railcar-engaging section wherein the tilt arm is in an operative position.
Figure 12B:
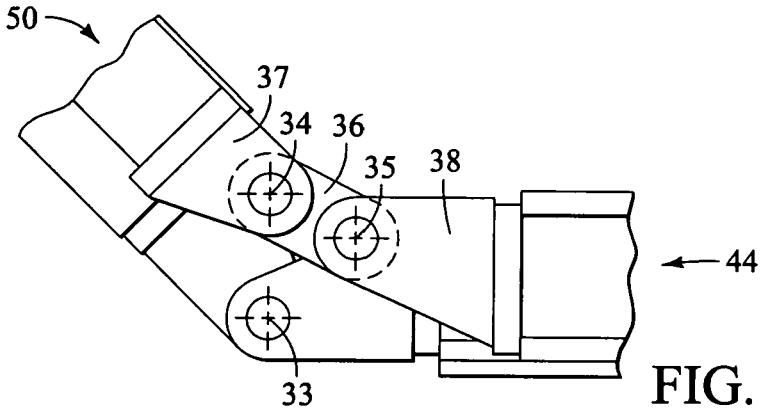
FIG. 12B is a side view of a connection between the tilt arm and railcar-engaging section wherein the tilt arm is at an angled position.
Figure 12C:
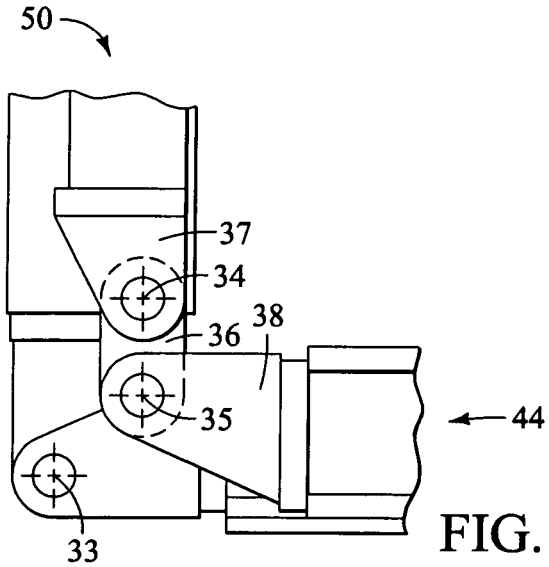
FIG. 12C is a side view of a connection between the tilt arm and railcar-engaging section wherein the tilt arm is in a vertical position; and, FIG. 12D is a top perspective view of the connection between the tilt arm and the railcar engaging section, wherein a portion of the top plate is removed.
Figure 12D:
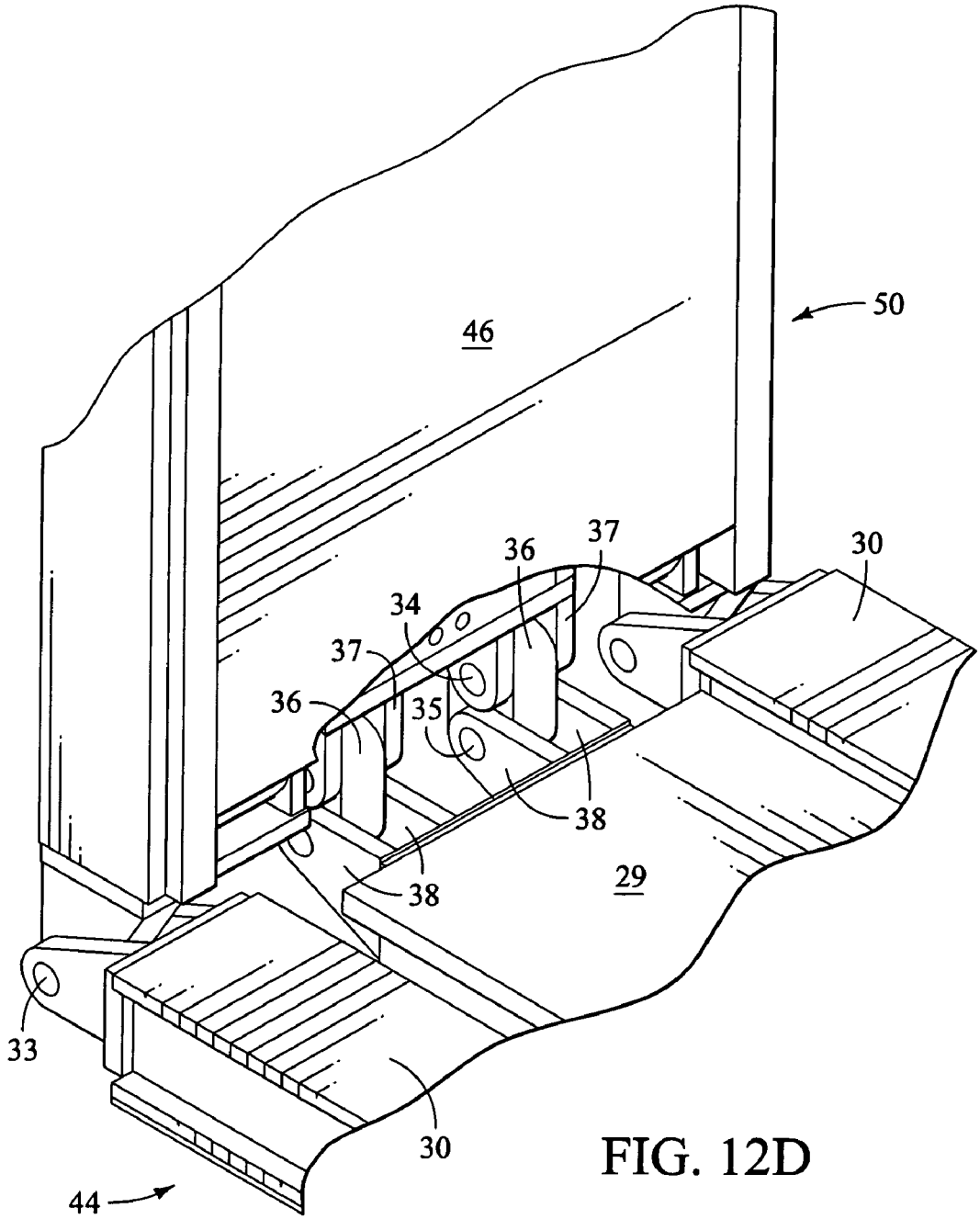

FIGS. 12A-12D illustrate the inner and outer connections 31, 32 between the tilt arm 50 and the railcar-engaging section 44 as the tilt arm 50 is rotated between the horizontal and vertical positions. In FIG. 12A, the knuckle links 36 are generally horizontal, and the first and second axes 33, 34 are vertically aligned with respect to each other. FIG. 12B illustrates the orientation of the first, second, and third axes 33, 34, 35 as the tilt arm 50 is being raised or lowered. FIGS. 12C and 12D illustrates the tilt arm 50 in the vertical position, wherein the second and third axes 34, 35 are vertically aligned with respect to each other.

The pair of hydraulic cylinders 74 of the lifting mechanism 46 in the tilt arm 50 operate to rotate the tilt arm 50 between the horizontal and vertical positions. When the jack assembly 41 is first placed beneath a railcar 12, the tilt arm 50 is in the horizontal position and the rods of the hydraulic cylinders 74 in the tilt arm 50 are extended about 20.3 cm (8 in.). The rods of the hydraulic cylinders 74 are contracted in order to rotate the tilt arm 50 to the vertical position. As the tilt arm 50 reaches the vertical position, the rods are completely contracted into the hydraulic cylinders 74. As the moving masts 54 of the lifting mechanisms 45, 46 are raised, the rods of both hydraulic cylinders 74 are extended, thereby lifting the railcar-engaging member 29 together as a unit with the moving masts 54.

OPERATION OF THE INVENTION

As previously discussed, the jack assembly 41 is placed between a set of railroad track rails 20 and the frame 18 of a railcar 12. Preferably, the railcar-engaging section 44 is placed beneath the railcar 12 such that the power unit 42 is located on one side of the railcar 12 and the tilt arm 50 is located on the opposite side of the railcar 12. The jack assembly 41 is placed in an operative position such that the frame rails 30 are in a substantially perpendicular relationship with respect to the track rails 20. In one embodiment, the frame rails 30 of the railcar-engaging section 44 include markings on the upper surface to assist the user in aligning the jack assembly 41 atop the set of track rails 20. In an alternative embodiment, an electronic device is attached to the first lifting mechanism in order to detect the distance between the first lifting mechanism and the frame of the railcar to ensure proper alignment of the jack assembly. Proper alignment of the jack assembly 41 results in more efficient use by preventing one of the opposing lift mechanisms 45, 46 from bearing a disproportional amount of the weight of the railcar 12.

Once the jack assembly 41 is aligned beneath the railcar 12, the housing 48 of the power unit 42 is rotated to the open position, whereby the operational controls of the jack assembly 41 can be accessed by the user. The motor is activated, and power is provided to the electrical control system. The user is then free to depress the "up" and "down" buttons on the control pendant to control the movement of the jack assembly 41.

To raise the railcar with the jack assembly 41, the user depresses the "up" button. Once the "up" button is depressed, the electrical control system activates the hydraulic pump to provide power only to the pair of hydraulic cylinders 74 located in the tilt arm 50. First, the slightly extended rods of the hydraulic cylinders 74 in the tilt arm 50 are contracted, and the pistons 108 in the safety bar locking mechanism 100 are actuated to allow the moving mast 54 to be lowered with respect to the fixed mast 52. As the rods of the hydraulic cylinders 74 are contracted, the tilt arm 50 rotates from the horizontal position to the vertical position. When the tilt arm 50 has rotated to the vertical position, the rods of the hydraulic cylinders 74 in the tilt arm 50 are completely contracted. The railcar-engaging section 44 includes a magnetic switch (not shown) that is activated once the tilt arm 50 has reached the vertical position. The activation of the magnetic switch signals the electronic control system to supply power to the hydraulic cylinders 74 in both lifting mechanisms 45, 46 as the "up" button remains depressed. Once the magnetic switch is activated, the power supplied to the pistons 108 in the safety bar locking mechanism 100 is interrupted, and the die springs 106 bias the safety pins 102 into sliding engagement with the rack 94 of the safety bar 68. Thus, as the hydraulic pump provides power to the hydraulic cylinders 74, the moving masts 54 of the opposing lifting mechanisms 45, 46 and the railcar-engaging member 29 are raised to the height determined by the user. Once the lifting mechanisms 45, 46 have reached the desired height, the user releases the button on the control pendant in order to interrupt the power supplied to the hydraulic cylinders 74. Once the power to the lifting mechanisms 45, 46 is interrupted, the safety pins 102 in the safety bar locking mechanism 100 engage the rack 94 of the safety bar 68 in order to maintain the desired height of the lifting mechanisms 45, 46 and railcar-engaging member 29.

To lower the lifting mechanisms 45, 46 and the railcar-engaging member 29 from a raised position, the "up" button must be momentarily depressed in order to actuate the pistons 108 in the safety bar locking mechanism 100 to move the safety pins 102 out of engagement with the rack 94 of the safety bar 68. The "down" button can then be pressed to slowly release the pressure in the hydraulic cylinders 74, thereby lowering the lifting mechanisms 45, 46 and the railcar-engaging member 29. Once the hydraulic cylinders 74 have reached the bottom of their stroke, the magnetic switch between the tilt arm 50 and the railcar-engaging section 44 is deactivated. The pair of hydraulic cylinder rods of the lifting mechanism 76 of the tilt arm are then extended to lower the tilt arm 50 from the vertical position to the horizontal position. The jack assembly 41 can then be removed from beneath the railcar 12 and transported to another location with a forklift.

While preferred embodiments of the invention have been described, it should be understood by one skilled in the art that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A jack assembly comprising:

a pair of spaced apart parallel frame rails;

a rotatable first lifting mechanism operatively connected to at least one of said frame rails;

a second lifting mechanism operatively connected to at least one of said frame rails;

a railcar engaging member extending at least partially between said first lifting mechanism and said second lifting mechanism; and a power unit located adjacent to one of said lifting mechanisms, said power unit attached to both of said spaced apart frame rails and configured to actuate said lifting mechanisms.

2. The jack assembly of claim 1, wherein said first lifting mechanism is rotatable between a first operative position and a second operative position.

3. The jack assembly of claim 2, wherein said first lifting mechanism is in a substantially horizontal orientation when in said first operative position.

4. The jack assembly of claim 3, wherein said first lifting mechanism is in a substantially vertical orientation when in said second operative position.

5. The jack assembly of claim 1, wherein said railcar engaging member is actuatable between a first position and a second position.

6. The jack assembly of claim 5, wherein said railcar engaging member is configured to be in contact with a frame of a railcar when said railcar engaging member is actuated to said second position.

7. The jack assembly of claim 1, wherein said first lifting mechanism comprises a first fixed mast and a first moving mast and said second lifting mechanism comprises a second fixed mast and a second moving mast.

8. The jack assembly of claim 7, wherein at least one of said first lifting mechanism and said second lifting mechanism further comprises a safety mechanism.

9. The jack assembly of claim 8, wherein said safety mechanism further comprises a safety bar and a safety bar guide, and said safety mechanism configured to prevent dropping a railcar as said railcar is being raised or lowered.

10. The jack assembly of claim 9, wherein said safety bar is ratcheted.

11. The jack assembly of claim 9, wherein said safety bar is connected to said first fixed mast of said first lifting mechanism and said safety bar guide is connected to said first moving mast of said first lifting mechanism, and said safety bar being disposed within a slot through said safety bar guide.

12. The jack assembly of claim 9, wherein said safety bar is connected to said second fixed mast of said second lifting mechanism and said safety bar guide is connected to said second moving mast of said second lifting mechanism, and said safety bar being disposed within a slot through said safety bar guide.

13. The jack assembly of claim 1, wherein said power unit further comprises a control pendant, a motor, a hydraulic pump, and hydraulic valves.

14. The jack assembly of claim 3, wherein said power unit includes a housing which is configured to be rotatable between an open position and a closed position.

15. The jack assembly of claim 1, wherein said second lifting mechanism is rotatable between a first operative position and a second operative position.

16. The jack assembly of claim 1, wherein said first lifting mechanism and said second lifting mechanism are configured to actuate said railcar engaging member between a first operative position and a second operative position.

17. The jack assembly of claim 1, wherein said power unit comprises hydraulic controls.

18. A method of elevating a railcar above a pair of railroad track rails comprising:

providing a jack assembly having a pair of spaced apart parallel frame rails, a power unit attached to both of said spaced apart frame rails, a first lifting mechanism, a second lifting mechanism spaced apart from said first lifting mechanism, and a railcar-engaging member operatively connected to said first and second lifting mechanisms; and applying hydraulic pressure to said first and second lifting mechanisms, wherein said hydraulic pressure activates said first and second lifting mechanisms, thereby causing said first and second lifting mechanisms and said railcar-engaging section to move together between a first position and a second position.

19. A jack assembly comprising:

a pair of spaced apart parallel frame rails;

a rotatable first lifting mechanism operatively connected to at least one of said frame rails;

a second lifting mechanism operatively connected to at least one of said frame rails, said second lifting mechanism comprising a fixed mast and a moving mast;

a railcar engaging member extending at least partially between said first lifting mechanism and said second lifting mechanism; and a power unit located adjacent to said second lifting mechanism, said power unit attached to said fixed mast of said second lifting mechanism and both of said spaced apart frame rails, said power unit configured to actuate said first and said second lifting mechanisms.

* * * * *